US005807296A

United States Patent [19]

Stubbs

[11] Patent Number: 5,807,296

[45] Date of Patent: Sep. 15, 1998

[54] METHOD OF STOPPING BLOOD FLOW USING A FIRST AID MITT

[76] Inventor: Tommy D. Stubbs, 3119 Jackson Passage, Bloomington Springs, Tenn. 38545

[21] Appl. No.: 773,914

[22] Filed: Dec. 27, 1996

Related U.S. Application Data

[63] Continuation of Ser. No. 442,788, May 17, 1995, abandoned, which is a continuation-in-part of Ser. No. 282,064, Jul. 28, 1994, abandoned.

[51] Int. Cl.[6] ..... A61F 13/00

[52] U.S. Cl. ..... 602/41; 604/304; 2/161.7

[58] Field of Search ..... 602/21, 53, 62, 602/64, 41, 42; 604/292, 289, 304; 2/16, 18, 19, 20, 159, 161.7

[56] References Cited

U.S. PATENT DOCUMENTS

| | | | |
|---|---|---|---|
| 1,882,179 | 10/1932 | Daly . | |
| 2,141,739 | 12/1938 | Burke | 604/292 |
| 3,633,216 | 1/1972 | Schonholtz | 2/168 |
| 3,813,695 | 6/1974 | Podell, Jr. et al. | 2/168 |
| 4,091,491 | 5/1978 | Hoffman | 15/227 |
| 4,523,348 | 6/1985 | Petrie | 15/227 |
| 4,645,251 | 2/1987 | Jacobs | 294/1.3 |
| 4,967,418 | 11/1990 | Marcolte | 2/161 |
| 5,019,058 | 5/1991 | Storandt | 604/290 |
| 5,058,209 | 10/1991 | Eisenberg | 2/161 |
| 5,140,998 | 8/1992 | Vickers | 128/879 |

*Primary Examiner*—Corrine M. McDermott
*Attorney, Agent, or Firm*—Waddey & Patterson; Mark J. Patterson

[57] ABSTRACT

A fluid resistant first aid mitt for use in control of bleeding by direct pressure is described. The mitt includes two thumb sheaths, making the mitt suitable for use by either hand. The mitt has a large opening and a large internal cavity that makes it quick and easy to put on and remove. The finger section of the mitt is wide enough to accept all four fingers of the user's hand, which eliminates wasted time on inserting each finger. The mitt can also include an attached dressing, which saves time in locating necessary pressure dressings.

4 Claims, 3 Drawing Sheets

METHOD OF STOPPING BLOOD FLOW USING A FIRST AID MITT

This application is a continuation of U.S. patent application Ser. No. 08/442,788 filed May 17, 1995, now abandoned, which is a continuation-in-part application of U.S. patent application Ser. No. 08/282,064 filed on Jul. 28, 1994 for "Double Thumb Mitt and Attached Dressing".

BACKGROUND OF THE INVENTION

The present invention relates generally to a first-aid article, and more particularly to an article for the control of bleeding.

In first-aid, the first step in the control of bleeding has always been direct pressure. The pressure was to be applied with a clean cloth or with the fingers. It is no longer recommended that direct pressure be applied without proper protection. The rapid spread of the human immunodeficiency virus (HIV) and the hepatitis B virus (HBV) has initiated a major change in techniques for the control of bleeding.

On Dec. 6, 1991, the Occupational Safety and Health Administration (OSHA) added 29 C.F.R. § 1910.1030—Bloodborne Pathogens to their guidelines. It became effective on Mar. 6, 1992. It states: "This section applies to all occupational exposure to blood or other potentially infectious materials. Universal Precautions is an approach to infection control. According to the concept of Universal Precautions, ALL human blood and certain human body fluids are treated as if known to be infectious for HIV and HBV and other bloodborne pathogens. Where there is occupational exposure, the employer must provide appropriate personal protective equipment. Gloves shall be worn when it can be reasonably anticipated that the employee may have contact with blood. Work Practice Controls means controls that reduce the likelihood by altering the manner in which a task is performed."

Disposable gloves invented and used today have the traditional four fingers and thumb, as found in U.S. Pat. No. 3,813,695 issued to D. Podell, Jr. on Jun. 4, 1974; and U.S. Pat. No. 3,633,216 issued to G. Schonholtz on Jan. 11, 1972. It will be appreciated by those skilled in the art that valuable time is lost when donning gloves one finger at a time. After the gloves are on, it is necessary to locate and secure dressings for direct pressure. Again, valuable time is wasted. The lost time allows more splashing, splattering, and generating of droplets of blood. This allows the possible spread of bloodborne pathogens.

No prior art mitts have two thumbs, making these mitts for the right or left hand only. Examples of said prior art mitts are found in U.S. Pat. No. 5,019,058 issued to D. Storandt on May. 28, 1991, having no thumb; protection while playing goal-position, in ice hockey, U.S. Pat. No. 4,967,418 issued to H. Marcotte on Nov. 7, 1990; Skin Care while bathing someone, U.S. Pat. No. 4,091,491 issued to S. Hoffman on May. 30, 1978; or Nursing Case while bathing a patient, U.S. Pat. No. 4,523,348 issued to C. Petrie on Jun. 8, 1985.

The prior art mitts do not address the problem of bloodborne pathogens. There was no prior art directed to a double thumb mitt or to a glove or mitt with a dressing attached. None of the prior art mitts are used for the control of bleeding. None are for protection from bloodborne pathogens.

What is needed, then, is a first aid mitt that is fluid resistant, that is designed to be put on and removed readily, and that can be used on either hand. Such a mitt is presently lacking in the prior art.

SUMMARY OF THE INVENTION

This invention is directed to a first aid mitt comprising a fluid resistant body having at one end a wrist section and at the other end a finger section having a closed end, the wrist section having an opening, the opening leading to an internal cavity that proceeds from the opening to the closed end of the finger section; a fluid resistant first thumb sheath extending diagonally from one side of the body and a fluid resistant second thumb sheath extending diagonally from the opposite side of the body, the thumb sheaths located at points along the sides of the body that are substantially directly opposite each other, the thumb sheaths having internal cavities, the sheaths' internal cavities connected to the internal cavity of the body at a sufficient angle to accept either of the user's thumbs; and a mounting area for a dressing on an external surface of the body substantially between the thumb sheaths and the closed end of the finger section.

The thumb sheaths can extend diagonally from the body into a plane lying substantially at a forty-five degree angle from a plane in which the body lies. The opening and the internal cavity of the body preferably incorporate a sufficient volume to allow a user's hand to be readily placed into and removed from the mitt. The internal cavity of the body should also have a width across the finger section to accept all four fingers of the user's hand.

The mitt can also include a dressing attached to the mounting area. The mitt can further include two mounting areas for the dressing, one on a top external surface and one on a bottom external surface of the body. The mounting area can be located at the closed end of the finger section of the body.

Accordingly, several objectives and advantages of my invention are: protection, speed, decreased generation of blood, ambidexterity, economy, quicker control of an emergency and safe disposal of contaminated materials.

The mitt provides a way to save valuable time by eliminating the cumbersome task of donning gloves, one finger at a time. The absorbent dressing can be attached with a water-resistant adhesive that can be applied to both the dressing and the mitt. This eliminates locating the necessary pressure dressings.

It provides an extremely fast way to safely minimize blood flow. A user simply slips either hand into the mitt through the large opening. For those not practiced, it eliminates any struggle with the fingers. By saving time and eliminating any struggle, it provides a calming effect. In an emergency, it is necessary to remain calm.

The second thumb makes the mitt ambidextrous, thus reducing wasted materials. One protective mitt is used instead of two gloves. The use of one mitt frees the other hand to provide fine motor finger dexterity.

The ease of application stimulates the use of protection by the first responder. The mitt is in line with today's disease control guidelines. By following Universal Precautions, the victim and the care giver are protected. After use, the mitt can be reversed. The contaminated dressing, which remains attached, is contained within the mitt. Thus, contact with blood is avoided and proper disposal technique can then be followed.

Further objects and advantages of my invention will become apparent from a consideration of the drawings and ensuing description.

DESCRIPTION OF THE PREFERRED EMBODIMENT

Figure 1:
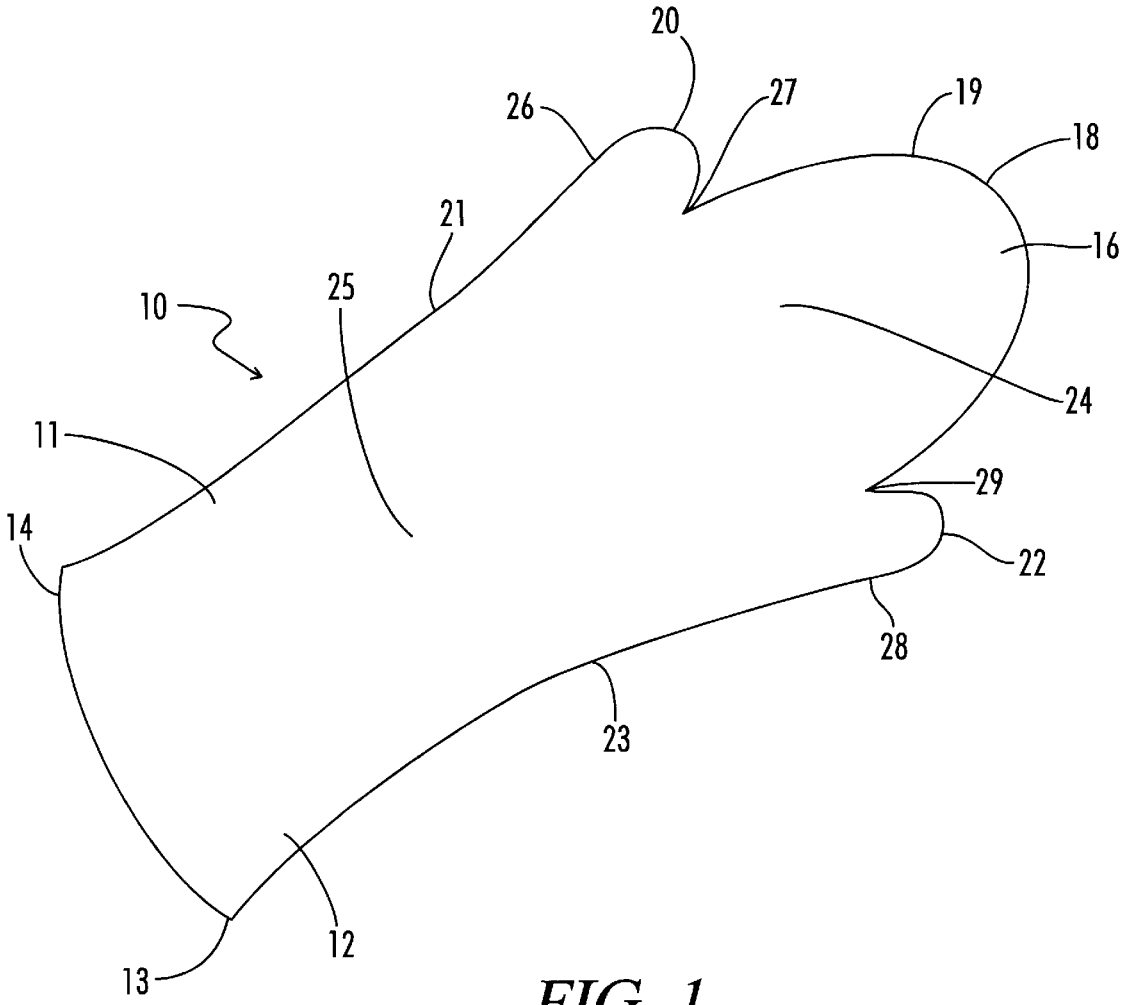
FIG. 1 is a perspective view of the mitt of this invention without a dressing.

Referring now to FIG. 1, a perspective view of the first aid mitt of this invention is shown. The first aid mitt is referred to generally as 10. Mitt 10 comprises a fluid resistant body 11 merging at one end into a wrist section 12 and at the other end into a finger section 16. Wrist section 12 is long enough to adequately protect the user's forearm from exposure to blood. Wrist section 12 has an opening 14 into which the user places his or her hand at its end 13. Finger section 16 is closed at the end 18 that is opposite end 13.

Side edges 21, 23 of body 11 run from opening 14 for the length of wrist section 12 to first and second thumb sheath beginning points 26, 28. Side edges 21, 23 continue from first and second thumb sheath beginning points 26, 28 to first and second thumb sheath end points 27, 29 in an thumb-shaped path to define first and second thumb sheaths 20, 22. First and second thumb sheaths 20, 22 are also fluid resistant.

Side edges 21, 23 continue from first and second thumb sheath end points 27, 29 and meet in finger section 16 to form terminal edge 19. Preferably, the terminal edge 19 of finger section 16 is curved as it proceeds from first thumb sheath 20 to second thumb sheath 22.

First and second thumb sheath beginning points 26, 28 are closer to the closed end 18 of the finger section 16 than to the opening 14 at the end 13 of the wrist section 12 to reflect the proximity of a user's thumb to a user's fingers. Additionally, first thumb sheath beginning and end points 26, 27 and second thumb sheath beginning and end points 28, 29 are substantially directly opposite each other.

As described above, fluid resistant first thumb sheath 20 is integrated with body 11 and extends diagonally from body 11 beginning at point 26. Fluid resistant second thumb sheath 22 is also integrated with the body 11 and extends diagonally from body 11 beginning at point 28. The diagonal along which thumb sheaths 20, 22 extend away from body 11 is substantially a 45° angle from the longitudinal center of the mitt 10.

A mounting area 24 for an absorbent dressing (dressing not shown in FIG. 1) lies on an external surface 25 of the body 11 substantially between the thumb sheaths 20, 22 and the closed end 18 of finger section 16. The mounting area 24 thus lies above the palm and palm-side of the fingers of the user's hand when the hand is placed into the mitt 10.

Figure 2:
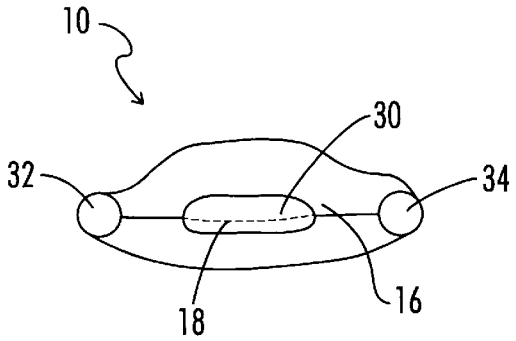
FIG. 2 is a cross sectional view from the closed end of the mitt.
Figure 3:
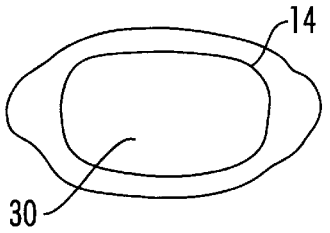
FIG. 3 is a cross sectional view from the opening of the mitt.

Referring now to FIGS. 2 and 3, the internal cavity 30 of the mitt 10 is depicted. Internal cavity 30 extends from opening 14 to closed end 18 of finger section 16. Internal cavity 30 has a sufficient width in finger section 16 to accept all four fingers of the user's hand. Opening 14 and internal cavity 30 define an internal volume adequate to allow a user's hand to be readily placed into and removed from the mitt. The thumb sheaths 20, 22 have individual internal cavities 32, 34 which are connected to the internal cavity 30 of the body 11 at such an angle as to readily accept either of the user's thumbs. As stated above, this angle is substantially 45 degrees. Internal cavities 32, 34 of first and second thumb sheaths 20, 22 can be of a sufficient width and length to accommodate thumbs of any size.

Figure 4:
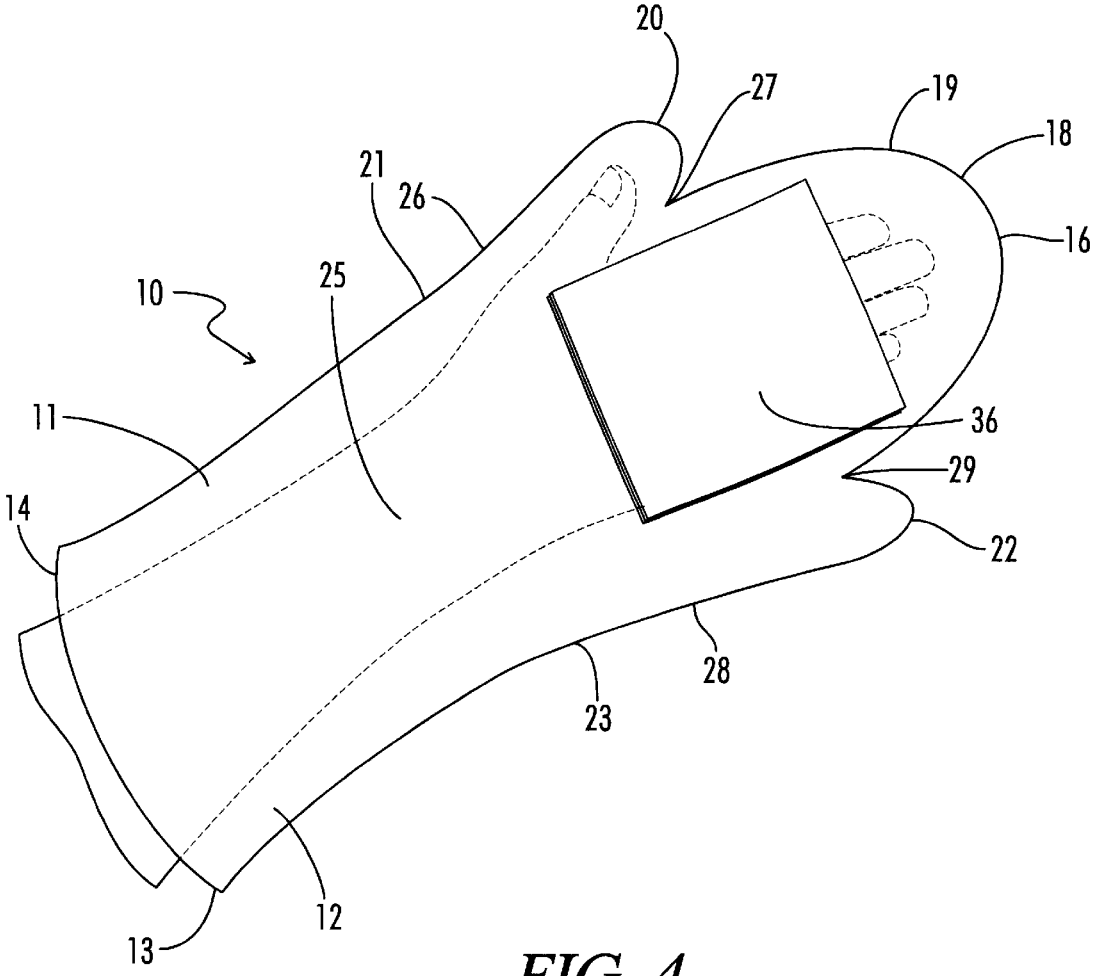
FIG. 4 is a perspective view of the mitt and dressing of the present invention.

Referring now to FIG. 4, the placement of the absorbent dressing 36 is shown. Absorbent dressing 36 is attached to the mounting area 24 of mitt 10, which, as stated above, lies substantially between the thumb sheaths 20, 22 and closed end 18 of the finger section 16. This placement allows the user to apply direct pressure through the absorbent dressing 36 to a wound using the palm and palm-side of the fingers of a user's hand when they are placed inside the mitt 10. Additionally, the user can manipulate his/her thumb as it rests inside thumb sheath 20 or 22 to grip or otherwise secure the user's hand to the wound area. Thus, the inter-relationship between thumb sheaths 20 and 22 and the placement of absorbent dressing 36 allow mitt 10 to be used ambidextrously.

The absorbent dressing 36 can be any suitable dressing and can vary in size and thickness. Indeed, mitt 10 can also vary in size, but is preferably "one size fits all". An example of a dressing 36 is a gauze pad. Dressing 36 can be attached using any suitable means for attachment. For example, the dressing 36 can be attached by an adhesive. The adhesive can be applied to both the dressing 36 and the mounting area 24. An acceptable adhesive would preferably be water resistant.

Alternatively, the mounting area 24 could be located at the closed end 18 of the finger section 16 of the body 11. The mitt 10 could then serve as a larger version of a cotton-tip swab, but grip control would lessened.

Figure 5:
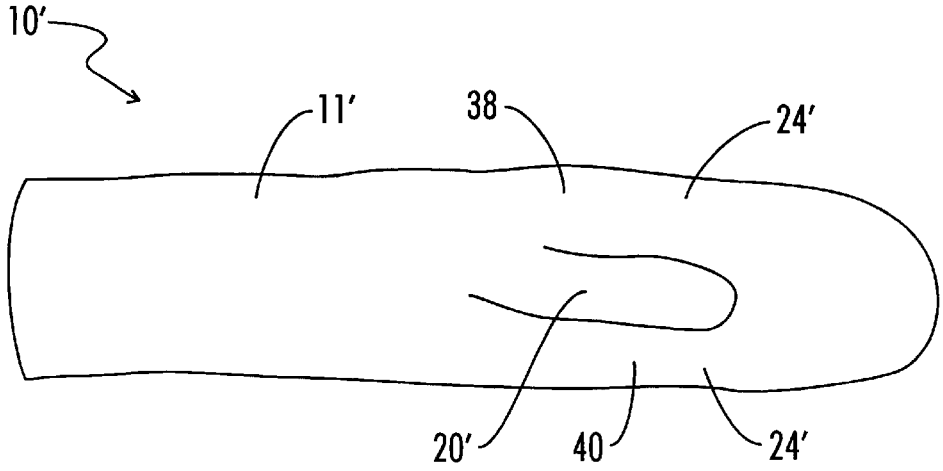
FIG. 5 is a plan view of an alternative embodiment of the mitt with only one thumb sheath.

Referring now to FIG. 5, an alternative embodiment of the mitt 10' is depicted. This embodiment has two mounting areas 24', one located on a top external surface 38 of body 11' and one located on a bottom external surface 40 of body 11'. This embodiment of the invention allows the mitt to be used ambidextrously even if the mitt has only one thumb sheath 20' (as shown in FIG. 5) in that absorbent dressings 36' could be attached to both mounting areas 24' if desired. The user can then place either hand into mitt 10' so that the user's fingers are in finger section 16' and the user's thumb is in thumb sheath 20' and apply pressure to a wound through the absorbent dressing 36' that is mounted on the mounting area 24' that covers the palm and palm-side of the fingers of the user's hand.

Figure 6:
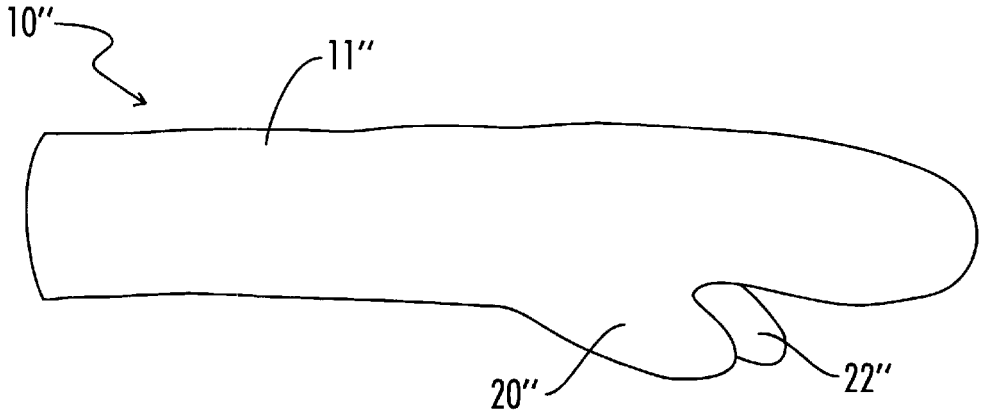
FIG. 6 is a plan view of another alternative embodiment of the mitt.

Referring now to FIG. 6, another alternative embodiment of the mitt 10" is depicted. In this embodiment, thumb sheaths 20", 22" extend diagonally from the body 11" into a plane lying substantially at a 45° from the plane in which the body 11" lies. This embodiment of the invention appreciates the fact that when at rest, the user's thumb lies in a plane substantially at a 45° angle from the plane in which the user's palm and fingers lie. Thus, this embodiment of the invention improves the gripping function of the mitt 10" while maintaining the ambidextrous feature of the mitt 10".

The spaciousness of the opening 14 and the internal cavity 30 of the mitt 10 allows the mitt to be easily turned inside out when the user removes it from a wound. When turned inside out, the bloody dressing is then enclosed within the fluid resistant mitt 10 for safer and easier disposal.

Mitt 10 and its alternative embodiments 10' and 10" can be made using a variety of techniques that are well known in the art. For example, mitt 10 can be formed as an integral unit using techniques that are well-known in the art. Alternatively, the mitt 10 may be formed by stitching two mirror image pieces of the fluid resistant material together using methods well known in the art. Suitable fluid resistant materials are well known in the art and examples include plastics, rubber including latex, or the like.

Thus, although there have been described particular embodiments of the present invention of a new and useful first aid mitt, it is not intended that such references be construed as limitations upon the scope of this invention except as set forth in the following claims. Further, although there have been described certain dimensions used in the preferred embodiment, it is not intended that such dimensions be construed as limitations upon the scope of this invention except as set forth in the following claims.

What I claim is:

1. A method of stopping blood flow from an injury, the method comprising the steps of:

a. putting on a first aid mitt, the first aid mitt comprising:

i. a fluid resistant body having at a first end a wrist section and at a second end a finger section, the finger section having a closed end, the wrist section having an opening, the opening leading to an internal cavity that runs from the opening to the closed end of the finger section;

ii. a fluid resistant thumb sheath extending diagonally from a side of the body, the thumb sheath having an internal cavity, the sheath's internal cavity connected to the internal cavity of the body at a sufficient angle to accept the user's thumb; and iii. a dressing mounted on an external surface of the body substantially between the thumb sheath and the closed end of the finger section;

b. applying pressure to the injury using the first aid mitt.

2. The method according to claim 1 wherein the thumb sheath of the mitt extends diagonally from the body into a plane lying substantially at a forty-five degree angle from a plane in which the body lies.

3. The method according to claim 1 wherein the opening and the internal cavity of the body of the mitt define an internal volume sufficient to allow a user's hand to be readily placed into and removed from the mitt; and the method further includes the step of reversing the mitt so that the dressing is contained within the mitt after the dressing has absorbed blood from the wound.

4. The method according to claim 1 wherein the mitt includes a second fluid resistant thumb sheath extending diagonally from the opposite side of the body from the first fluid resistant thumb sheath.

* * * * *